US007436118B2

(12) United States Patent
Adachi et al.

(10) Patent No.: US 7,436,118 B2
(45) Date of Patent: Oct. 14, 2008

(54) PLASMA DISPLAY PANEL WITH LIGHT-SHIELDING LAYER

(75) Inventors: Daisuke Adachi, Kyoto (JP); Hiroyuki Yonehara, Osaka (JP); Toshimoto Kubota, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 207 days.

(21) Appl. No.: 10/543,304

(22) PCT Filed: Nov. 25, 2004

(86) PCT No.: PCT/JP2004/017900

§ 371 (c)(1),
(2), (4) Date: Jul. 26, 2005

(87) PCT Pub. No.: WO2005/052976

PCT Pub. Date: Jun. 9, 2005

(65) Prior Publication Data

US 2006/0145622 A1 Jul. 6, 2006

(30) Foreign Application Priority Data

Nov. 26, 2003 (JP) ..... 2003-395223

(51) Int. Cl.
*H01J 17/49* (2006.01)

(52) U.S. Cl. ..... 313/583; 313/586

(58) Field of Classification Search ..... 313/582–587; 345/37, 41, 60; 315/169.1, 169.3, 169.4
See application file for complete search history.

(56) References Cited

U.S. PATENT DOCUMENTS 4,076,894 A * 2/1978 Langley et al. ..... 428/428

(Continued)

FOREIGN PATENT DOCUMENTS

EP 1 168 079 A1 1/2002

(Continued)

OTHER PUBLICATIONS

European Search Report issued in European Patent Application No. EP 04799898.4-2208/1589556 PCT/2004017900 dated on Jul. 11, 2008.

*Primary Examiner*—Nimeshkumar D. Patel
*Assistant Examiner*—Anne M Hines
(74) *Attorney, Agent, or Firm*—McDermott Will & Emery LLP

(57) ABSTRACT

A plasma display panel is disclosed. It can display quality videos and its manufacturing steps can be reduced. A pair of substrates (3), (11) confront each other to form dischargeable space (16) in between. At least front one (3) of the substrates is transparent, and includes display electrodes (6) formed of scan electrodes (4) and sustain electrodes (5), as well as light-blocking sections (7) corresponding to non-dischargeable sections (18) disposed between the display electrodes (6). The other substrate (11) facing to rear includes phosphor layers (15R), (15G), (15B) which emit light by discharging. Each one of display electrodes (6) is formed of transparent electrodes (4*a*), (5*a*) and bus electrodes (4*b*), (5*b*) which are formed of a plurality of electrode-layers. At least one of the electrode-layers is made of black layer (19) having a specific volume resistance ranging from $1\times10^5$ Ωcm to $1\times10^9$ Ωcm, and light-blocking sections (7) are made of identical material of black layer (19).

6 Claims, 2 Drawing Sheets

U.S. PATENT DOCUMENTS

| | | | | |
|---|---|---|---|---|
| 5,714,286 | A | 2/1998 | Uchikawa et al. | |
| 6,429,918 | B1 | 8/2002 | Choi et al. | |
| 6,522,070 | B1 | 2/2003 | Nakazawa et al. | |
| 6,555,594 | B1 | 4/2003 | Fukushima et al. | |
| 6,838,828 | B2 * | 1/2005 | Joo et al. | 313/584 |
| 2003/0090204 | A1 | 5/2003 | Joo et al. | |
| 2004/0142623 | A1 | 7/2004 | Joo et al. | |

FOREIGN PATENT DOCUMENTS

| | | | |
|---|---|---|---|
| EP | 1 308 982 | A2 | 5/2003 |
| JP | 9-160243 | | 6/1997 |
| JP | 2000-156166 | | 6/2000 |
| JP | 2000-221671 | | 8/2000 |
| JP | 2001-15037 | | 1/2001 |
| JP | 2002-75229 | | 3/2002 |
| JP | 2002-083547 | | 3/2002 |
| JP | 2003-151443 | | 5/2003 |
| JP | 2003-151450 | | 5/2003 |

* cited by examiner

PLASMA DISPLAY PANEL WITH LIGHT-SHIELDING LAYER

This application is a U.S. national phase application of PCT international application PCT/JP2004/017900.

TECHNICAL FIELD

The present invention relates to plasma display panels to be used in plasma display devices that are known as display devices featuring a large size screen, and yet, a thin body and a light weight

BACKGROUND ART

A plasma display panel (hereinafter referred to as PDP) displays videos by the following method: generating ultraviolet rays by gas discharge, then the ultraviolet rays excite phosphor to emit light.

The PDPs are divided into two types in terms of driving methods, namely, an AC driven PDP and a DC driven PDP, and two discharge methods are available in PDPs, namely, a surface discharge PDP and an opposed discharge PDP. Presently the AC driven and surface discharge PDP having three electrodes becomes a mainstream in the market, which requires PDPs of a higher resolution, easiness for increasing a screen size, a simpler structure, and easiness for manufacturing.

The AC driven PDP is formed of a front plate and a rear plate. The front plate comprises the following elements:

- a display electrode formed of scan electrodes and sustain electrodes on a substrate made of glass;
- light blocking sections between the display electrodes;
- a dielectric layer for covering both of the display electrodes and the light blocking sections; and
- a protective layer for covering the dielectric layer.

The rear plate comprises the following elements:

- plural address electrodes formed on a glass substrate and oriented orthogonally to the display electrodes of the front plate;
- a dielectric layer for covering the address electrodes; and
- barrier ribs formed on the dielectric layer.

The front plate is opposed to the rear plate, so that discharge cells are formed at the intersections of the display electrodes and data electrodes. The discharge cells have a phosphor layer therein.

Each one of the display electrodes includes a transparent electrode and a bus electrode. The bus electrode is formed of a black electrode and a metal electrode made of mainly metal. The black electrode suppresses reflection of external light, and the metal electrode has a low resistance.

The PDPs have drawn attention recently among other flat panel displays because of the following advantages over liquid crystal display panels:

- displaying videos at a higher speed;
- having a greater view angle;
- easiness for upsizing; and
- better display quality due to self-luminous panel.

The PDPs are thus employedin various applications for entertainment such as display devices used at community plazas or large screens of home entertainment devices.

Japanese Patent Application Unexamined Publication No. 2002-83547 discloses a structure of the light blocking sections formed between each one of the display electrodes as well as the black layer as a structural element of the display electrode. The structure is this: a group of the electrodes is made of plural layers formed on a substrate, and one of the layers is made of a black layer having a higher sheet resistance than the other layers so that the one layer forms a black electrode. This black layer is integral with the light blocking sections.

However, when the black layer and the light blocking layer are commonly used as discussed above, electrostatic capacitance increases in the light blocking layer as a resistance of the black layer decreases, so that the power consumption increases. On the other hand, a greater resistance of the black layer increases an electric resistance of a transparent electrode, which is an element of the display electrode, so that the display characteristics are degraded.

The present invention addresses the problems discussed above, and aims to reduce the number of manufacturing steps and achieve PDPs that can display quality videos.

SUMMARY OF THE INVENTION

In order to achieve the foregoing objectives, the PDP of the present invention comprises the following elements:

- a pair of substrates confronting each other for forming a dischargeable space therebetween, and at least front one of the substrates being transparent;
- a display electrode including a scan electrode and a sustain electrode, and light blocking sections corresponding to non-dischargeable sections between each one of the display electrodes, and prepared in the front substrate; and
- a phosphor layer prepared on the rear substrate and illuminated by discharge.

Each one of the display electrodes is formed of a transparent electrode and a bus electrode. The bus electrode is formed of plural electrode-layers, and at least one of the electrode-layers is formed of a black layer made of material having a specific volume resistance ranging from $1\times10^5$ to $1\times10^9$ Ωcm. The light blocking section is formed of the same material as that of the black layer.

The foregoing structure allows achieving a PDP excellent in display characteristics and consuming a fewer power and also being manufactured with a fewer manufacturing steps.

DETAILED DESCRIPTION OF PREFERRED EMBODIMENT

Figure 1:
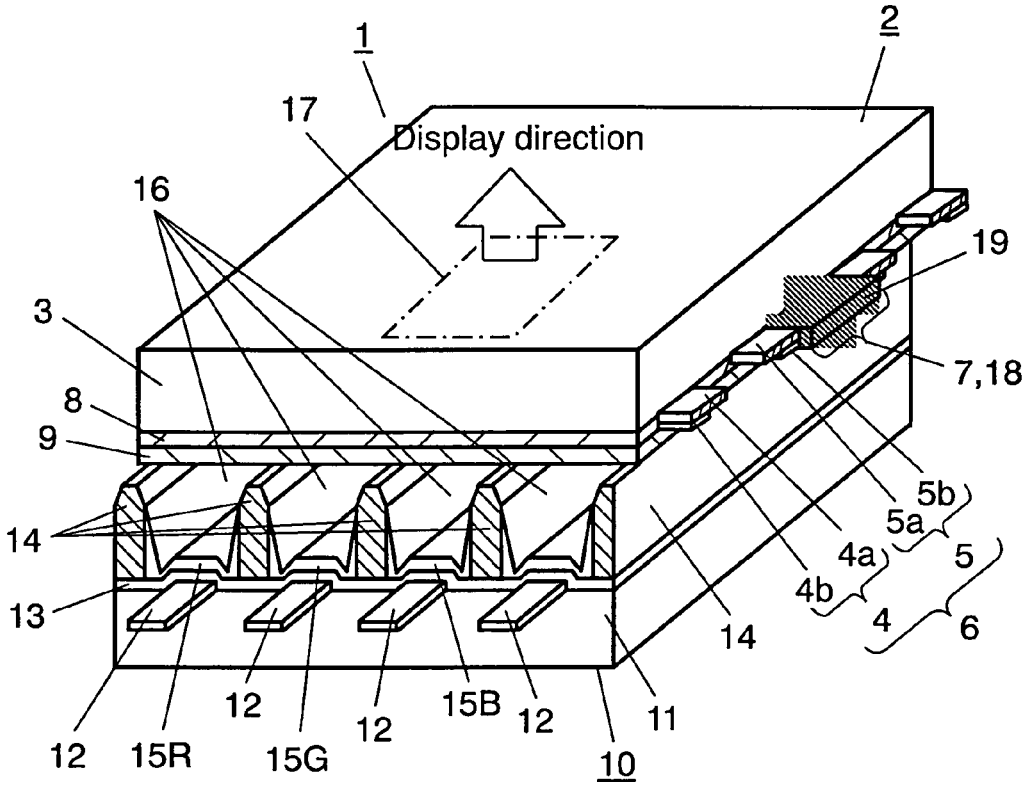
FIG. 1 shows a perspective sectional view illustrating a schematic structure of a PDP in accordance with an exemplary embodiment of the present invention.

A PDP in accordance with an exemplary embodiment of the present invention is demonstrated hereinafter with reference to the accompanying drawings. FIG. 1 shows a perspective sectional view illustrating a schematic structure of the PDP in accordance with an exemplary embodiment of the present invention.

Front plate 2 of PDP 1 comprises the following elements:

substrate 3 facing the front and formed by a float method, like a sheet of glass, and being smooth, transparent and insulating;

display electrode 6 formed of scan electrode 4 and sustain electrode 5 prepared on a principal plane of substrate 3;

light blocking section 7 formed on the principal plane and prepared between display electrodes 6 adjacent to each other;

dielectric layer 8 covering both of the display electrodes and light blocking sections 7; and protective layer 9 made of e.g. MgO and covering dielectric layer 8.

Each on of scan electrodes 4 and sustain electrodes 5 are formed by laminating bus electrodes 4*b*, 5*b* respectively on transparent electrodes 4*a*, 5*a*, and both the bus electrodes 4*b*, 5*b* are made of good conductive material such as metal for reducing electric resistance. Light blocking section 7 blocks reflective light from the phosphor layer of the rear plate so that better contrast is obtainable.

Rear plate 10, on the other hand, comprises the following elements:

substrate 11 facing the rear and formed by a float method, like a sheet of glass, and being smooth and insulating;

address electrodes 12 formed on a principal plane of substrate 11;

dielectric layer 13 covering address electrodes 12 and formed on the principal plane;

barrier ribs 14 prepared between address electrodes 12 adjacent to each other formed on dielectric layer 13; and phosphor layers 15R, 15G, 15B formed on the sides of barrier ribs 14 and on dielectric layer 13, and emitting light of red, green and blue respectively.

Front plate 2 and rear plate 10 are placed confronting each other such that display electrodes 6 are oriented orthogonally to address electrodes 12 with barrier ribs 14 in between. The front and rear plates are sealed together with sealant member, and space 16 therebetween is filled with dischargeable gas of Ne—Xe 5% at about 66.5 kPa (ca. 500 Torr). This structure allows the intersections of display electrodes 16 and address electrodes 12 in dischargeable space 16 to work as discharge cells 17 (each one of cells 17 is counted as a unit of light emitting area).

Figure 2:
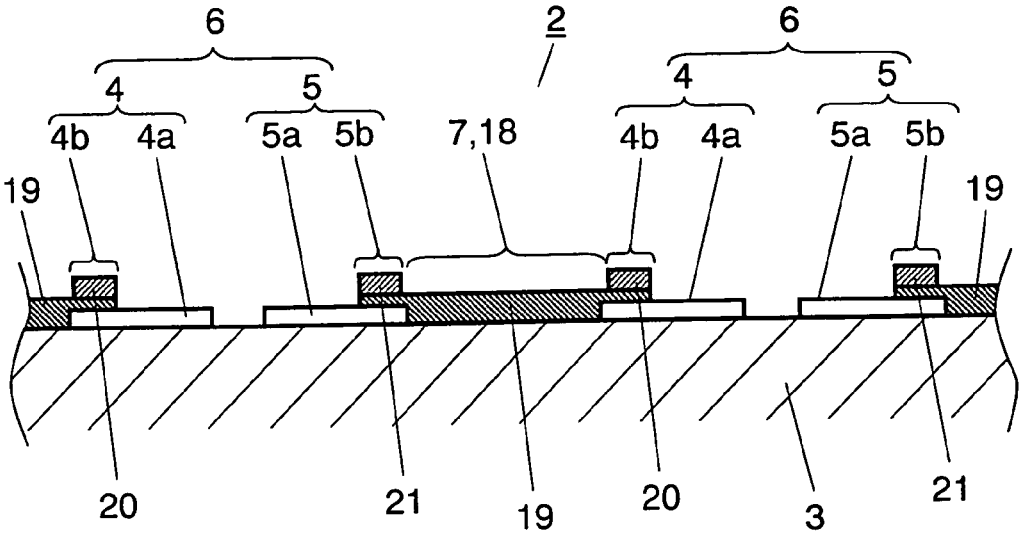
FIG. 2 shows a sectional view illustrating a schematic structure of a display electrode and a light blocking section of the PDP shown in FIG. 1.

Next, structures of display electrode 6 and light blocking section 7 of the PDP in accordance with this embodiment are described hereinafter with reference to FIG. 2. FIG. 2 shows a sectional view illustrating a schematic structure of display electrode 6 and light blocking section 7 of the PDP in accordance with this embodiment. Display electrode 6 is formed of a pair of electrodes, namely, scan electrode 4 and sustain electrode 5, and those electrodes are respectively formed of transparent electrodes 4*a*, 5*a* made of $SnO_2$ or ITO, and bus electrodes 4*b*, 5*b* prepared on parts of transparent electrodes 4*a*, 5*a*.

Bus electrodes 4*b*, 5*b* are formed by laminating plural electrode-layers as follows: forming black layer 19 as an electrode layer on transparent electrodes 4*a*, 5*a*, then forming metal electrodes 20, 21 as electrode-layers on black layer 19. Black layer 19 is made of material including ruthenium tetroxide and having a comparatively high electric resistance. Metal electrodes 20, 21 formed on black layer 19 are made of material, such as silver, having a low resistance.

In non-dischargeable section 18 between display electrodes 6 adjacent to each other, light blocking section 7 integrally formed with black layer 19 as an electrode layer is prepared. In other words, when light blocking section 7 is formed in non-dischargeable section 18 between scan electrode 4 and sustain electrode 5 adjacent to each other, black layer 19 is formed such that it covers parts of scan electrode 4 and sustain electrode 5. As a result, light blocking section 7 is integrally formed with black layer 19 of bus electrodes 4*b*, 5*b*.

The foregoing structure allows forming light blocking section 7 integrally and simultaneously with black layer 19 of bus electrodes 4*b*, 5*b*. This structure is advantageous over the prior art, i.e. using material independently in separate steps of forming light blocking section 7 and black layer 19, so that the material can be used more efficiently and the number of steps can be reduced.

If the specific volume resistance of black layer 19 is less than $10^5$ Ωcm in the foregoing structure, i.e. display electrodes 6 adjacent to each other are coupled with black layer 19, a portion of electric current leaks from between the adjacent display electrodes 6 via black layer 19 when the PDP is driven, thereby interfering with a driving voltage waveform of display electrode 6. As a result, discharge cells 17 cannot receive a predetermined voltage waveform, and the PDP thus cannot display videos excellent in picture quality.

However, since the PDP in accordance with this embodiment employs black layer 19 made of high resistance material and thus having a specific volume resistance not lower than $10^5$ Ωcm, the interference with the driving voltage waveform is suppressed, and the PDP achieves excellent display characteristics. A smaller resistance of black layer 19 increases a electrostatic capacitance of light blocking section 7, so that the PDP consumes a larger power; however, the resistance value of black layer 19 of the present invention is high enough to suppress increasing the power consumption.

On the other hand, if the specific volume resistance of black layer 19 exceeds $10^9$ Ωcm, the electric resistance between metal electrodes 20, 21 and transparent electrodes 4*a*, 5*a* becomes greater. When an electric current flows from metal electrodes 20, 21 to transparent electrodes 4*a*, 5*a*, a voltage drop across black layer 19 increases, so that discharge cells 17 sometimes cannot receive a voltage high enough to discharge, which adversely affects displaying videos. In such a case, an amount of the voltage drop across black layer 19, namely, a black electrode, is superimposed on a signal waveform, which is then supplied to metal electrodes 20 and 21, so that discharge cell 17 can receive a voltage high enough to discharge. In this case, both of the driving voltage and the power consumption are obliged to increase.

However, since the maximum specific volume resistance of black layer 19 in accordance with this embodiment is $1\times10^9$ Ωcm, so that the increases of both the driving voltage and power consumption can be suppressed.

As discussed above, the PDP of the present invention selects the specific volume resistance of black layer 19 from the range between $1\times10^5$ and $1\times10^9$ Ωcm.

The resistance values of black layer 19 in bus electrodes 4*b*, 5*b* or that in light blocking section 7 can be changed by a film thickness. An extraordinary thin film allows a portion of incident light into black layer 19 to transmit, which causes insufficient light blocking. As a result, an effect on improving the contrast is reduced. On the other hand, an extraordinary thick film makes it difficult to pattern electrodes when they are formed. The film thickness thus can be variable within the range of 1 μm-5 μm. On top of this, the selection of a specific volume resistance from the range of $1\times10^5$-$1\times10^9$ Ωcm can suppress an adverse effect due to the change in resistance of black layer 19 and also an adverse effect due to the degrading of light blocking performance. The specific volume resistance of black layer 19 is adjustable with an additive amount of ruthenium tetroxide.

Next, a method of manufacturing the PDP in accordance with this embodiment is demonstrated hereinafter with reference to FIG. 1 and FIG. 2.

First, form scan electrodes 4 and sustain electrodes 5 in a striped pattern on substrate 3 facing the front of front plate 2 of PDP1. To be more specific, form an ITO film by an electron-beam evaporation method on substrate 3 facing the front. The ITO film is the material of transparent electrodes 4*a*, 5*a*. Then apply resist thereon for patterning, and etch the film of transparent electrodes 4*a*, 5*a*. Finally, peel the resist for forming transparent electrodes 4*a*, 5*a* patterned. Meanwhile, $SnO_2$ can be also used as the material of the transparent electrodes.

Next, form bus electrodes 4*b*, 5*b* and light-blocking section 7 on transparent electrodes 4*a*, 5*a* thus formed. To be more specific, using the following materials, form black layer 19 on substrate 3 facing the front by a screen printing method:

- black pigment such as Cr—Co—Mn based, or Cr—Fe—Co based black oxide;
- an oxide containing conductive material such as ruthenium tetroxide or ruthenium;
- PbO—$B_2O_3$—$SiO_2$ based, or $Bi_2O_3$—$B_2O_3$—$SiO_2$ based glass frit; and
- photosensitive black paste containing photo polymerization initiator, photo curing monomer, and organic solvent;

Then dry and expose black layer 19 to light.

On black layer 19 thus formed, form a film of metal electrode by a screen printing method using the following materials:

- conductive material containing Ag;
- PbO—$B_2O_3$—$SiO_2$ based, or $Bi_2O_3$—$B_2O_3$—$SiO_2$ based glass frit; and
- photosensitive Ag paste containing polymerization initiator, photo curing monomer, and organic solvent.

Then dry the metal electrode film thus formed.

Expose display electrode 6 to light by a photolithography method. Then light-blocking section 7 and display electrode 6 together undergo developing and firing, so that light-blocking section 7 as well as bus electrodes 4*b*, 5*b* are formed. Bus electrodes 4*b*, 5*b* are formed of black layer 19, which works as a black electrode, and metal electrodes 20, 21.

As discussed above, the present invention allows forming black layer 19 of bus electrodes 4*b*, 5*b* in display electrode 6 and light-blocking section 7 simultaneously and integrally. As a result, the number of steps of manufacturing display electrodes 6 and light-blocking sections 7 can be reduced.

Next, cover the display electrodes 6 and light-blocking sections 7 thus formed with dielectric layer 8, which is made by the following steps: apply paste containing lead-based glass material by a screen printing method, then dry and fire the paste. After that, cover dielectric layer 8 with protective layer 9 which is made of MgO and formed through a film-forming process such as evaporation or sputtering.

On the other hand, rear plate 10 is formed of substrate 11 facing the rear and address electrodes 12 prepared, e.g. in a stripped pattern on substrate 11. To be more specific, apply a film of photosensitive Ag paste, which is the material of address electrode 12, onto substrate 11 facing the rear by a screen printing method, then provide the paste film with patterns by a photolithography method, and fire the paste patterned. Next, cover address electrode 12 thus formed with dielectric layer 13, which is made by the following method: apply paste containing lead-based glass material by a screen printing method, then dry and fire the paste. In stead of applying the paste by the screen printing method, laminate film-like molded pre-bodies of the dielectric layer, and fire the laminated pre-bodies for forming dielectric layer 13.

Next, barrier ribs 14 are prepared in a stripped pattern. Ribs 14 are formed by the following method: form a film of photosensitive paste, of which major ingredients are aggregate made of $Al_2O_3$ and glass frit, by a printing method or a die-coat method. Then provide the film with patterns by a photolithography method, and fire the patterned film for forming barrier ribs 14. Another method of forming ribs 14 is this: apply the paste containing lead-based glass material at given intervals repeatedly by the screen printing method, then dry and fire the paste. Spaces between each one of barrier ribs 14 are approx. 130 μm-240 μm in the case of HDTV having a screen size of 32-50 inches.

Between each one of barrier ribs 14, phosphor layers 15R, 15G and 15B are formed respectively, those layers are formed of respective phosphor particles of red, green and blue. Each phosphor layer is formed by the following method: apply paste-like phosphor ink which is made of phosphor particles of each color and organic binder, then dry the ink, and fire the dried ink at 400-590° C., so that the organic binder is burned off. As a result, phosphor particles of each color are bound to each other for forming phosphor layers 15R, 15G, and 15B.

Front plate 2 is overlaid with rear plate 10 thus manufactured such that display electrodes 6 of front plate 2 are oriented orthogonally to address electrodes 12 of rear plate 10. The edges of the plates overlaid with each other are framed up by sealing member such as sealing glass, which is then fired at 450° C. for 10-20 minutes to form an air-tight sealing layer (not shown), thereby sealing the two plates together. Evacuate dischargable space 16 to a highly vacuum condition (e.g. $1.1\times10^{-4}$ Pa), then fill space 16 with dischargable gas (e.g. He—Xe based or Ne—Xe based gas), so that PDP 1 is completed.

The material of black layer 19 of the PDP in accordance with this embodiment contains black pigment, ruthenium tetroxide, and frit glass, and the specific volume resistance of black layer 19 can be adjusted with an additive amount of ruthenium tetroxide. That has been discussed in this embodiment. However, instead of the materials and method discussed above, the black pigment, metal conductive material, and the frit glass can be used for black layer 19, and the specific volume resistance can be adjusted with an additive amount of the metal conductive material, e.g. Ag powder. Black layer 19 is not necessarily colored in pure black, and it can be dark enough to achieve the light-blocking purpose.

Figure 3:
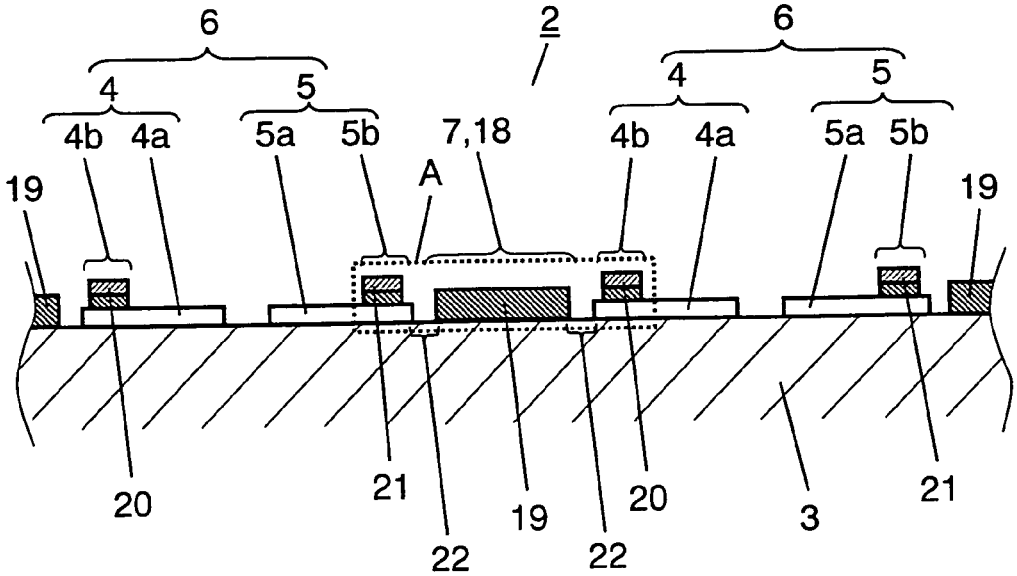
FIG. 3 shows a sectional view illustrating a schematic structure of a display electrode and a light blocking section of a PDP in accordance with another exemplary embodiment of the present invention.

FIG. 3 shows a sectional view illustrating a schematic structure of a display electrode and a light-blocking section of a PDP in accordance with another exemplary embodiment of the present invention. As shown in FIG. 3, slit 22 is provided between display electrode 6 and light-blocking section 7, so that those two electrodes are separated in terms of a physical structure.

In this structure, since light-blocking section 7 is electrically insulated from display electrode 6, interference with the driving voltage waveforms by display electrodes 16 adjacent to each other can be substantially suppressed. As a result, this structure allows black layer 19 to select materials of a lower resistance. However, use of a lower resistance material in black layer 19 increases an electrostatic capacitance of the area (area A in FIG. 3) including black layer 19 of light-blocking section 7 and display electrodes 6 disposed on both the sides of section 7. As a result, a power consumption in driving the PDP increases. The specific volume resistance of black layer 19 thus cannot be lowered limitlessly, and a certain amount of insulation must be retained. Considering those points, the specific volume resistance of black layer 19 is preferably not less than $1\times10^5$ Ωcm, and some waveforms prefer $1\times10^6$ Ωcm, although the specific volume resistance can be changed by a structure of PDP, material of substrate 3 facing the front, or material of dielectric layer 8.

In the foregoing embodiment, ruthenium tetroxide is used as conductive material of black layer 19; however, black conductive material is needed for forming light-blocking section 7, so that some oxide containing ruthenium can be used instead of ruthenium tetroxide.

In the case of using metal conductive material as the conductive material, Cu, Pd, Pt, or Au can be used in order to prevent the glass substrate from turning yellow.

Samples of the PDP in accordance with the present invention are tested for evaluating their display characteristics and power consumption. The samples have slits 22 between respective display electrodes 6 and light-blocking sections (LBS) 7, and specifications of black layer 19 are varied for the test purpose. Table 1 below shows the specification and test result of the samples:

TABLE 1

| | Specific volume resistance of the black layer (Ω · cm) | | Conductive material in the black layer | | Display characteristics: comparison with No. 8 | Power consumption at non-lighting: comparison with No. 8 | Remarks |
|---|---|---|---|---|---|---|---|
| No. 1 | $1\times10^{-1}$ | | Ruthenium tetroxide + Ag | | ○ | Great | Exmp. 1 |
| No. 2 | $1\times10^{2}$ | | Ruthenium tetroxide | | ○ | Great | Exmp. 2 |
| No. 3 | $2\times10^{4}$ | | Ruthenium tetroxide | | ○ | Rather great | Exmp. 3 |
| No. 4 | $1\times10^{5}$ | | Ruthenium tetroxide | | ○ | Rather great | Embodiment 1 |
| No. 5 | $1\times10^{7}$ | | Ruthenium tetroxide | | ○ | Rather great | Another embod. 2 |
| No. 6 | $5\times10^{9}$ | | Ruthenium tetroxide | | ○-Δ | Rather great | Exmp. 4 |
| No. 7 | $1\times10^{11}$ | | Not available | | X | Rather great | Exmp. 5 |
| | Black electrode | LBS* | Black electrode | LBS | | | |
| No. 8 | $1\times10^{2}$ | $1\times10^{11}$ | Ruthenium tetroxide | N/A | — | — | Conventional one |

*LBS = light blocking section

Based on the exemplary embodiment, each one of PDP samples No. 1-7 employs a black layer having a specific volume resistance different from each other. Respective samples No. 2-6 employ ruthenium tetroxide as the conductive material in their black layers but the ruthenium tetroxide content in respective layers differs from each other, so that the different specific volume resistance in each sample is achieved. Sample No. 1 uses ruthenium tetroxide, to which Ag powder is added, as the conductive material, and sample No. 7 does not include the conductive material.

Sample No. 8 is a conventional PDP, and black electrodes of bus electrodes 4*b*, 5*b* and light-blocking section 7 are not integrally formed, but they are respectively formed of material independently prepared.

The display characteristics and the power consumption at non-lighting of sample PDPs No. 1-No. 8 are compared. The non-lighting means that the entire screen shows black in color. The display characteristics means that respective samples are driven by a voltage which drives sample No. 8 (conventional PDP) to full display, and the display statuses are compared.

Use of black material having a resistance lower than $2\times10^4$ Ωcm, namely, in the case of samples No. 1-3, proves that the power consumption at non-lighting is greater than that of sample No. 8, and the power consumption increases at a lower specific volume resistance.

Use of black material having a resistance higher than $1\times10^5$ Ωcm, namely, in the case of samples No. 4-7, proves that the power consumption at non-lighting is approximately the same as that of sample No. 8, i.e. conventional PDP.

Use of black material having a resistance higher than $5\times10^9$ Ωcm proves that a voltage applied to discharge cells at portions of the screen is insufficient, thereby lowering the brightness. This phenomenon becomes conspicuous when the specific volume resistance is higher than $1\times10^{11}$ Ωcm, namely, in the case of sample No. 7. The non-lighting areas thus spread over the screen.

The foregoing test proves that samples No. 4 and 5, which are made in accordance with the exemplary embodiment of the present invention, are excellent both in power consumption at non-lighting and display characteristics.

INDUSTRIAL APPLICABILITY

The present invention reduces the number of steps of manufacturing PDPs, and achieves PDPs excellent in displaying videos, so that the present invention is useful for display devices having a large screen.

The invention claimed is:

1. A plasma display panel (PDP) comprising:

a pair of substrates placed confronting each other for forming dischargeable space therebetween, at least front one of the substrates being transparent and including display electrodes formed of scan electrodes and sustain electrodes as well as light-blocking sections corresponding to non-dischargeable sections disposed between each one of the display electrodes, and the other substrate facing to rear including phosphor layers which emit light by discharging, wherein each one of the display electrodes is formed of a transparent electrode and a bus electrode, and the bus electrode is formed of a plurality of electrode-layers, and at least one of the electrode-layers is made of black layer having a specific volume resistance ranging from $1\times10^5$ Ωcm to $1\times10^9$ Ωcm, and the light-blocking sections are integrally made of an identical material of the black layer.

2. The PDP of claim 1, wherein the black layer includes black pigment and conductive material.

3. The PDP of claim 2, wherein the conductive material includes one of ruthenium tetroxide and an oxide containing ruthenium.

4. The PDP of claim 2, wherein the conductive material is made of metal conductive material.

5. The PDP of claim 4, wherein the metal conductive material contains at least one of Ag, Cu, Pd, Pt, and Au.

6. A plasma display panel (PDP) comprising:

a pair of substrates placed confronting each other for forming dischargeable space therebetween, at least front one of the substrates being transparent and including display electrodes formed of scan electrodes and sustain electrodes as well as light-blocking sections separated from the display electrodes and corresponding to non-dischargeable sections disposed between each one of the display electrodes, and the other substrate facing to rear including phosphor layers which emit light by discharging, wherein each one of the display electrodes is formed of a transparent electrode and a bus electrode, and at least one of the light-blocking sections is made of black layer having a specific volume resistance ranging from $1\times10^5$ Ωcm to $1\times10^9$ Ωcm.

* * * * *